US009775394B2

(12) United States Patent
Dagan

(10) Patent No.: US 9,775,394 B2
(45) Date of Patent: Oct. 3, 2017

(54) THREE-PLY PADDED HELMET

(71) Applicant: Playmaker LLC, Sylmar, CA (US)

(72) Inventor: Adam Dagan, Sylmar, CA (US)

( * ) Notice: Subject to any disclaimer, the term of this patent is extended or adjusted under 35 U.S.C. 154(b) by 0 days.

(21) Appl. No.: 14/217,088

(22) Filed: Mar. 17, 2014

(65) Prior Publication Data

US 2014/0298571 A1 Oct. 9, 2014

Related U.S. Application Data

(60) Provisional application No. 61/799,329, filed on Mar. 15, 2013.

(51) Int. Cl.

| | |
|---|---|
| ***A42B 3/12*** | (2006.01) |
| ***A63B 71/10*** | (2006.01) |
| ***A42B 3/00*** | (2006.01) |
| *A42B 3/16* | (2006.01) |
| *A63B 102/14* | (2015.01) |
| *A63B 102/22* | (2015.01) |

(52) U.S. Cl.

CPC ..... *A42B 3/00* (2013.01); *A42B 3/12* (2013.01); *A42B 3/16* (2013.01); *A63B 71/10* (2013.01); *A63B 2102/14* (2015.10); *A63B 2102/22* (2015.10); *A63B 2209/00* (2013.01); *A63B 2243/0066* (2013.01)

(58) Field of Classification Search

CPC .. A63B 71/10; A42B 3/00; A42B 3/10; A42B 3/12; A42B 3/16

USPC ..... 2/6.1, 411, 412, 414, 425

See application file for complete search history.

(56) References Cited

U.S. PATENT DOCUMENTS

| | | | | |
|---|---|---|---|---|
| D52,781 | S | 12/1918 | Budweiser | |
| 1,705,879 | A | 3/1929 | Rodgers | |
| 3,789,427 | A * | 2/1974 | Aileo | F41H 1/08 2/423 |
| 3,843,970 | A * | 10/1974 | Marietta | A42B 3/127 2/415 |
| 4,282,610 | A | 8/1981 | Steigerwald et al. | |
| D291,128 | S | 7/1987 | Grandsart | |
| D292,330 | S | 10/1987 | McColough | |
| 5,271,103 | A * | 12/1993 | Darnell | A42B 1/08 2/411 |
| 5,361,420 | A | 11/1994 | Dobbs et al. | |
| D357,555 | S | 4/1995 | Brueckner | |
| D363,145 | S | 10/1995 | Newman et al. | |
| 5,544,367 | A | 8/1996 | March, II | |
| 5,661,854 | A | 9/1997 | March, II | |
| 5,790,988 | A | 8/1998 | Guadagnino, Jr. et al. | |
| 5,930,841 | A | 8/1999 | Lampe et al. | |
| D439,377 | S | 3/2001 | Dagan | |
| 6,360,376 | B1 * | 3/2002 | Carrington | A42B 3/00 2/411 |

(Continued)

*Primary Examiner* — Katherine Moran

(74) *Attorney, Agent, or Firm* — Koppel, Patrick, Heybl & Philpott

(57) ABSTRACT

The invention provides various embodiments of a soft shell padded helmet comprising a plurality of pads, wherein each pad is configured in a multi-layer configuration. The different embodiments comprise elements to provide a padded helmet that is light-weight and adapted to reduce the risk of head trauma due to the multi-layered padded configuration. The padded helmet comprises a top portion and a side portion, wherein the top portion is coupled to the side portion and each of the top and side portions comprise a plurality of pads.

16 Claims, 3 Drawing Sheets

(56) References Cited

U.S. PATENT DOCUMENTS

| | | | | |
|---|---|---|---|---|
| 6,421,840 | B1 * | 7/2002 | Chen | A42B 3/06 2/172 |
| 2003/0221245 | A1 * | 12/2003 | Lee | A42B 3/063 2/412 |
| 2007/0157370 | A1 * | 7/2007 | Joubert Des Ouches | A42B 3/324 2/410 |

* cited by examiner

THREE-PLY PADDED HELMET

RELATED APPLICATION

This application claims the benefit of priority of U.S. Provisional Application Ser. No. 61/799,329 to Dagan, which was filed on Mar. 15, 2013. U.S. Provisional Application Ser. No. 61/799,329, including its drawings, schematics, diagrams and written description, is hereby incorporated in its entirety by reference.

BACKGROUND OF THE INVENTION

Field of the Invention

This invention relates to a soft shell padded helmet, and more particularly to a three-ply soft shell padded helmet.

Description of the Related Art

Head trauma resulting from sports and other activities is a common occurrence. Generally, head trauma occurs when an object impacts the head, thereby transferring energy to the head. The most common head trauma resulting from sports is a concussion, which occurs when the brain bangs inside the skull and is bruised. To reduce the incidence of concussion, it is common practice to wear a protective helmet. Protective helmets are ostensibly designed to deflect and absorb energy transmitted by impact to the helmet, thereby diminishing the risk of head and brain injury resulting from the impact.

Protective athletic helmets have been worn for almost a century, and have evolved from sewn leather, to helmets having molded plastic outer shells with suspension webbing or other head fitting structures such as foam pads, air bladders, or padded molding on their interior. Despite the evolution of the protective helmets, the reported rate of concussions has been increasing amongst student and professional athletes in many sports. While some experts have attributed this increase to better reporting and diagnosis, other experts have attributed the increase to increased forces generated as competitive athletes continue to increase in size (mass) and increase their ability to accelerate.

When an individual participates in contact sports activities such as football, lacrosse, hockey, and the like, it is common that parts of the individual's body are subject to impact and other physical contact. Various attempts have been made to provide padding as a means of protecting the individual during such activities. Conventional protective equipment can include, as nonlimiting examples, helmets, shoulder pads, thigh pads, and shin pads. Typical protective equipment may include reinforced-sponge type padding, such as a rubber sponge layer laminated with a stiff plastic layer.

It is an object of the invention to provide an improved helmet.

SUMMARY

The invention provides various embodiments of a soft shell padded helmet comprising a plurality of pads, wherein each pad is configured in a multi-layer configuration. The different embodiments comprise elements to provide a padded helmet that is light-weight and adapted to reduce the risk of head trauma due to the multi-layered padded configuration.

In one embodiment, as broadly described herein, a padded helmet comprising a top portion and a side portion, wherein the top portion is coupled to the side portion. The top and side portions each can comprise at least one pad and at least one opening. The at least one pad comprising a multi-layer configuration. The helmet can also comprise a coupling means coupled to the side portion to secure the padded helmet.

These and other aspects and advantages of the invention will become apparent from the following detailed description and the accompanying drawings which illustrate by way of example the features of the invention.

DETAILED DESCRIPTION

Figure 1A:
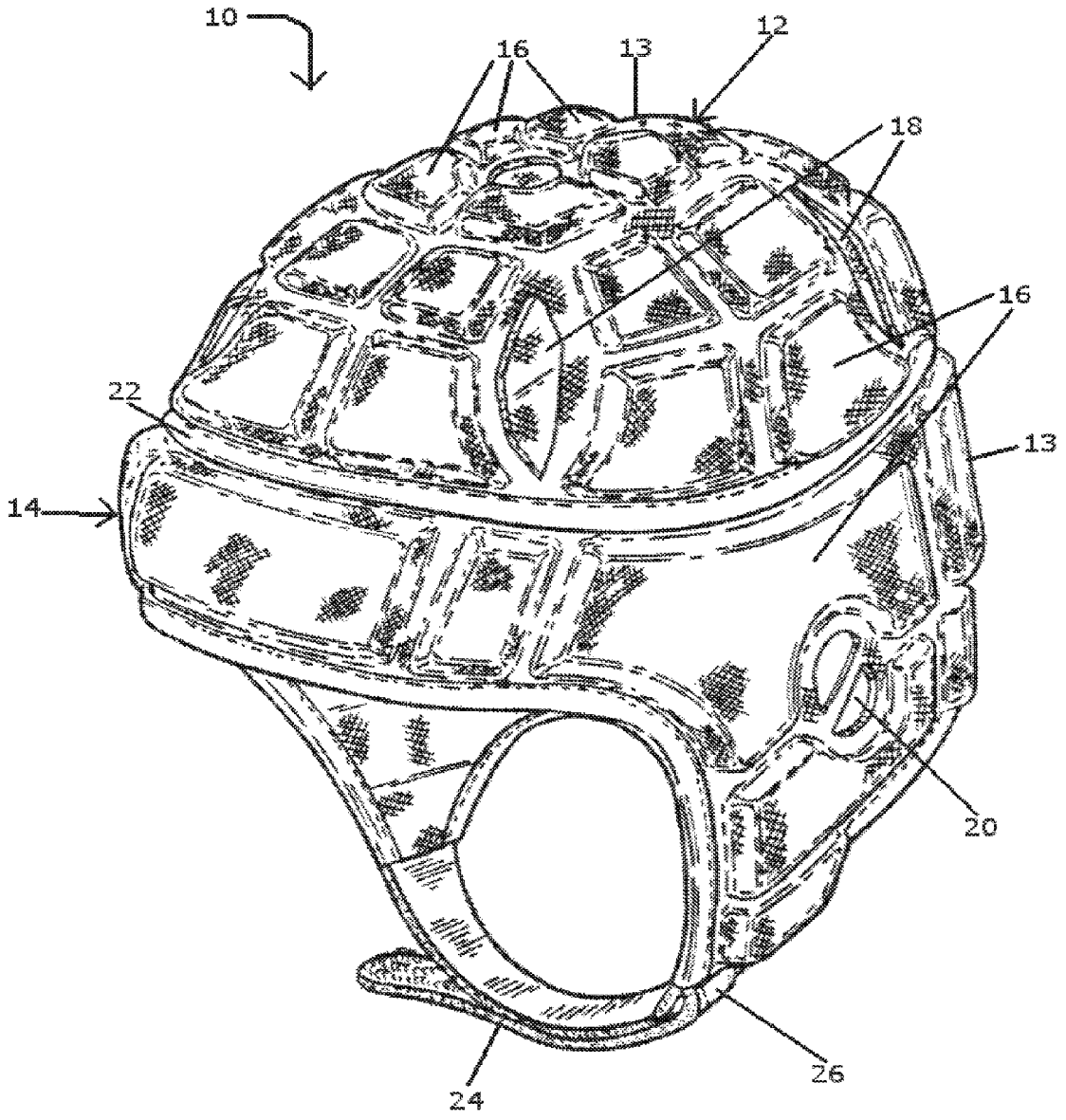
FIG. 1*a* is a perspective view of a padded helmet according to an embodiment of the invention.
Figure 1B:
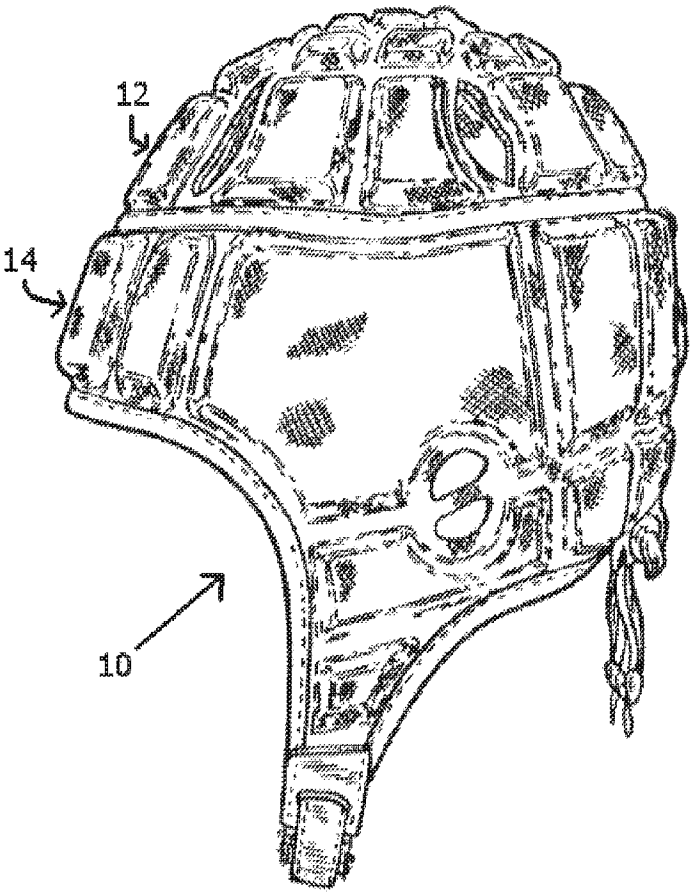
FIG. 1*b* is a side view of the padded helmet of FIG. 1.
Figure 1C:
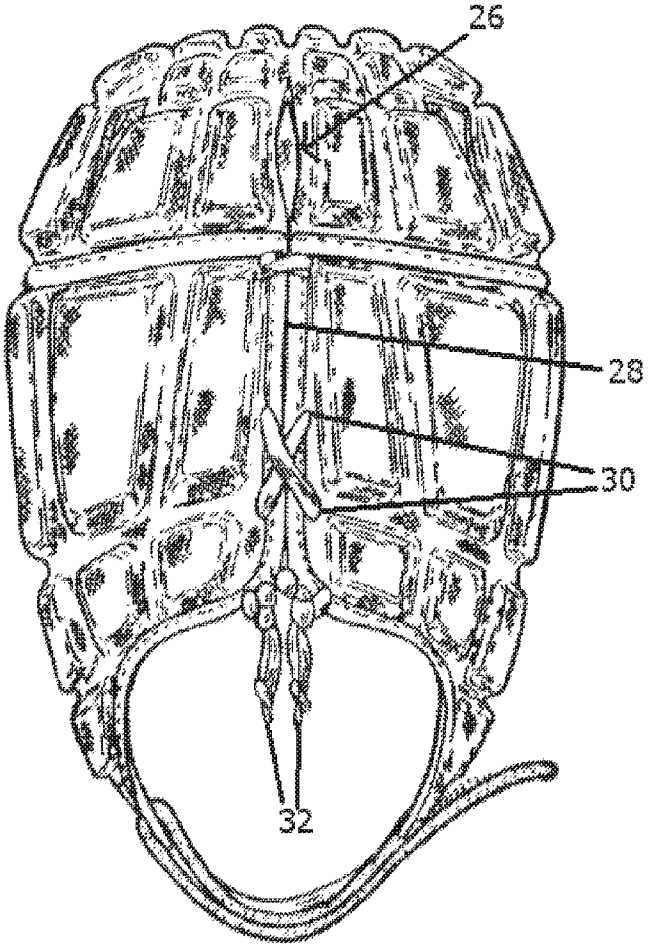
FIG. 1*c* is a rear view of the padded helmet of FIG. 1.
Figure 1D:
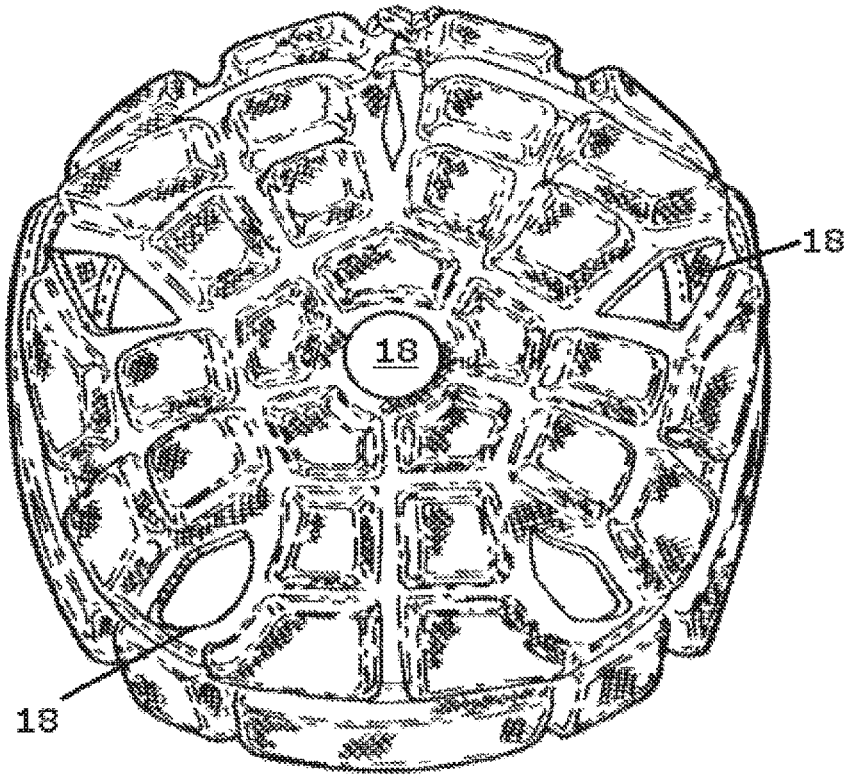
FIG. 1*d* is a top view of the padded helmet of FIG. 1.

The invention described herein is directed to different embodiments of a soft shell padded helmet comprising elements to provide a padded helmet that is light-weight and adapted to reduce the risk of head trauma. The padded helmet comprises a top portion and a side portion, wherein the top portion is coupled to the side portion.

The padded helmet covers a substantial portion of a user's head. The top portion comprising a plurality of pads and a plurality of venting holes to allow for ventilation. The top portion is arranged to cover a top portion of a user's head.

Some embodiments of the padded helmet according to the invention can be used to provide protection to a user's head while participating in athletic activities. However, the invention is not intended to be limited to such applications. The padded helmet can be used in many different applications, such as but not limited to, rehabilitative activities, as a medical device for individuals with concussions and/or developmental issues, and the like.

The invention is described herein with reference to certain embodiments, but it is understood that the invention can be embodied in many different forms and should not be construed as limited to the embodiments set forth herein. In particular, the invention is described below in regards to a padded helmet that can be used during athletic activities, but it is understood that the invention can be used for many other activities and can be arranged in many different configurations. The components can have different shapes and sizes beyond those shown in the figures or discussed herein.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual elements or components embodying the invention can be arranged in many different ways with many more features and elements beyond what is shown in the figures.

With reference to FIGS. 1*a*-1*d*, an exemplary padded helmet 10 is shown. The padded helmet 10 comprises a top portion 12 and a side portion 14, wherein the top portion 12 and side portion 14 are coupled. The top portion 12 can comprise a plurality of pads 16, a plurality of holes 18, and a shell 13 covering the pads and the exterior and interior surfaces of the top portion 12. The top portion 12 is arranged to cover the top of a user's head. The plurality of holes 18 allow for ventilation such that when a user is wearing the padded helmet 10, heat from the user's head can be easily dissipated.

The side portion 14 can comprise a plurality of pads 16 and shell 13, similarly as in the top portion 12. The side portion 14 can further comprise at least one earhole 20. The side portion 14 is arranged to cover the sides and rear portion of a user's head such that the at least one earhole 20 is aligned with the ears of the user. The at least one earhole 20 allows the user to hear while using the padded helmet 10 and can also provide ventilation to assist in dissipating heat from a user's head. Ventilation provides ease of use and comfort for the user, especially during long periods of use of the padded helmet 10.

The side portion 14 of the padded helmet 10 extends around the user's head and covers the sides, rear and part of the user's forehead. The side portion 14 is coupled to the top portion 12 in order to form the shape of the padded helmet 10. A seam 22 extends along the area between the top portion 12 and the side portion 14 in order to couple the top and side portions 12, 14.

The side portion 14 can further comprise a strap 24 to fasten the padded helmet 10 to the user's head, a plurality of pads 16 to provide protection to the sides and rear of the head, and an adjustment section 26. The adjustment section 26 comprises an opening 28, a plurality of holes 30 and a lace 32. The lace 32 is received within each of the plurality of holes 30 to adjust the size of the padded helmet 10 to accommodate different sized heads and/or to increase/decrease how tight the padded helmet 10 is on the user's head. The opening 28 runs along the back part of the padded helmet 10 between the top and side portion 12, 14 which allows the size of the padded helmet 10 to be adjusted. The strap 24 can comprise a hook and loop system in order to fasten the padded helmet to the user's head. However, the strap 24 can be arranged in many different ways and is not intended to be limited to a hook and loop system. In other embodiments, the strap 24 can be arranged as a belt, clasp, buttons, and/or any other known attachment device known in the art.

In one embodiment of the invention, the pads 16 are soft, shock-absorbent and assist in preventing head trauma to a user when wearing the padded helmet 10. The pads 16 can be arranged in many different configurations and many different shapes. In one embodiment, the pads 16 are shaped differently from one another. For example, the pads 16 on the top portion 12 are smaller in comparison to the pads 16 on the side portion 14, which allows the top portion 12 of the padded helmet 10 to be bent in the shape of the user's head. This allows the top portion 12 of the padded helmet 10 to closely conform and/or resemble the shape of the user's head and thereby provide maximum protection. The pads 16 on the side portion 14 of the padded helmet 10 are bigger, in size/shape, than the pads 16 on the top portion 12 because the curvature of the side of user's head is typically less curved than the curvature of the top of the user's head. The pads 16 are pliable and the pads 16 of the side portion 14 can substantially conform to the shape of the side of a user's head.

Each of the pads 16 can be arranged in a multi-layer configuration and are adapted to minimize direct impact and absorb more of a direct force than conventional soft padded helmets that are arranged as a single layer. In one embodiment, the pads 16 comprise a three-ply configuration of padding material comprising three different layers of padding material that are sandwiched together. The three layers of padding material are heat treated in order to couple each of the layers of padding material together to form the three-ply configured pads 16.

In one embodiment, each layer of padding material within the three-ply pads can have a different density and/or thickness. For example, a three-ply pad 16 can comprise a first, second, and third layers 40, 42, 44. The first layer can have a thickness of 15 mm, the second layer having a thickness of 35 mm, and the third layer having a thickness of 15 mm. The second layer 42 can be arranged to have a higher density than the first and third layers 40, 44, such that the second layer 42 is interposed between softer and/or less dense first and second layers 40, 44. This configuration offers maximum comfort and improved protection over conventional soft, single-layer padded helmets, while yet still being comfortable to the user. The invention is not intended to be limited to the thicknesses disclosed herein. The dimensions presented herein is an example of an embodiment of the invention, and the pads 16 can be arranged to have different dimensions. In other embodiments, the first, second and third layers 40, 42, 44 can have dimensions that are higher or lower than the sample dimensions disclosed herein.

Figure 2:
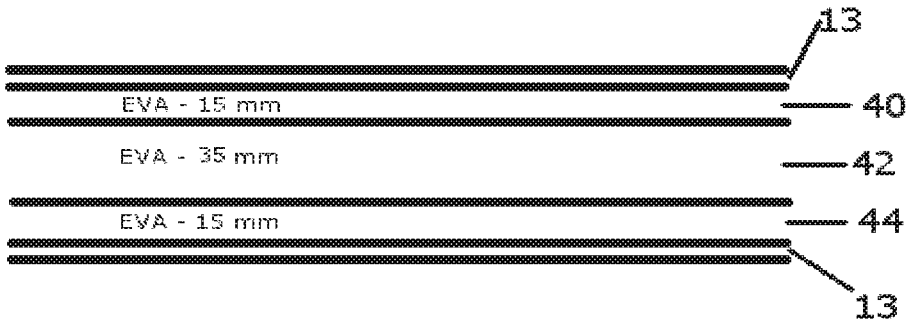
FIG. 2 is a cross-sectional view of the padded helmet of FIG. 1.

FIG. 2 discloses a cross-sectional view of one of the three-ply pads 16 used in the upper and side portions 12, 14 of the padded helmet 10, according to an embodiment of the invention. FIG. 2 shows the three-ply configuration of the pads wherein the second layer 42 made of denser material is surrounded by the softer and less dense first and third layers 40, 44. In the embodiment of FIG. 2, the pads 16 comprise three layers that are made of ethylene-vinyl acetate (EVA) that are heat treated in order to couple the layers 40, 42, 44 together, wherein the second layer is more dense than the first and second layers. However, the invention is not intended to be limited to three layers of EVA. The pads 16 of the padded helmet can be arranged in many different ways, such as but not limited to, having more than three-ply configuration, the pads having the same thickness and/or density, made of other materials in addition to EVA and/or a combination thereof. The padded helmet 10 can have a shell 13 formed of breathable, elastic, durable material on the interior and the exterior of the helmet, which helps make the helmet light-weight and breathable. The helmet can be used during sports and other activities or for people with balance problems, head/skull injuries, seizure disorders, and/or the like.

Although the invention has been described in detail with reference to certain configurations thereof, other versions are possible. In the embodiment of FIGS. 1*a*-*d* and 2, the shell can be formed of a natural material, synthetic material, and/or a combination thereof, such as but not limited to cotton, spandex, Lycra™, and/or any other material known in the art that is light-weight, elastic and breathable. Therefore, the spirit and scope of the invention should not be limited to the versions described herein.

I claim:

1. A padded helmet, comprising:

a top portion;

a side portion, wherein part of said top portion is coupled to said side portion;

a plurality of pads in each of said top and side portions, wherein each of said pads comprises:

a first layer;

a second layer; and a third layer, wherein said second layer is interposed between said first and second layer, wherein said second layer has a higher density than one of said first or third layer;

a soft shell covering exterior and interior surfaces of each of said plurality of pads of said top and side portions, wherein said top portion comprises a plurality of holes, wherein said plurality of holes extend through said soft shell; and a strap on said side portion to fasten said padded helmet.

2. The padded helmet of claim 1, further comprising an adjustment section comprising:

an opening;

a plurality of holes; and a lace, wherein said lace is received within each of said plurality of holes in order to adjust said padded helmet.

3. The padded helmet of claim 2, wherein said adjustment section is at a rear of said padded helmet, wherein said opening extends along the rear of said padded helmet between said top and side portions.

4. The padded helmet of claim 1, wherein said plurality of pads in said top portion are smaller than the plurality of pads in said side portion, such that said top portion is adapted to substantially conform to the shape of a user's head.

5. The padded helmet of claim 1, wherein said plurality of holes provide ventilation in order to assist with the dissipation of heat.

6. The padded helmet of claim 1, further comprising a seam along an area between said top portion and said side portion in order to couple said top and side portions.

7. The padded helmet of claim 1, wherein said second layer has a higher density than both of said first and third layers.

8. The padded helmet of claim 1, wherein said first layer has a thickness of 15 mm and said second layer has a thickness of 35 mm.

9. The padded helmet of claim 1, wherein said first layer has a thickness of 15 mm, said second layer has a thickness of 35 mm, and said third layer has a thickness of 15 mm.

10. The padded helmet of claim 1, wherein at least one of said first, second, or third layer is made of ethylene-vinyl acetate (EVA).

11. The padded helmet of claim 1, wherein each of said first, second, and third layers is made of EVA.

12. A padded helmet, comprising:

a top portion;

a side portion adjacent said top portion;

a seam coupling part of said top portion to said side portion; and a plurality of pads in said top portion, wherein exterior and interior surfaces of said top portion and side portion are covered by a soft shell, wherein said plurality of pads are arranged in concentric patterns about a central hole of said top portion and are adapted to be displaced to allow said top portion to adjust to different surfaces, wherein said soft shell covers exterior and interior surfaces of each of said plurality of pads in said top portion, wherein said top portion comprises a plurality of holes that extend through said soft shell;

wherein each of said plurality of pads comprise a plurality of layers, wherein at least one of said plurality of layers has a density greater than an adjacent one of said plurality of layers.

13. The padded helmet of claim 12, wherein said plurality of layers are heat treated in order to couple said plurality of layers.

14. The padded helmet of claim 12, wherein at least one of said plurality of layers has a thickness greater than an adjacent one of said plurality of layers.

15. The padded helmet of claim 12, wherein at least one of said plurality of layers is made of ethylene-vinyl acetate (EVA).

16. The padded helmet of claim 12, wherein each of said plurality of layers is made of EVA.

* * * * *